US005667062A

United States Patent [19]

Yasufuku et al.

[11] Patent Number: 5,667,062

[45] Date of Patent: Sep. 16, 1997

[54] PUSH SWITCH

[75] Inventors: Kenji Yasufuku, Maizuru; Yasuchika Kudo, Hirakata, both of Japan

[73] Assignee: Matsushita Electric Industrial Co., Ltd., Osaka, Japan

[21] Appl. No.: 651,975

[22] Filed: May 21, 1996

[51] Int. Cl.[6] ..... H01H 1/36

[52] U.S. Cl. ..... 200/536; 200/252; 200/260; 200/520

[58] Field of Search ..... 200/535, 530, 200/531, 532, 533, 546, 252, 260, 275, 276.1, 341, 536

[56] References Cited

U.S. PATENT DOCUMENTS

| | | | |
|---|---|---|---|
| 4,496,803 | 1/1985 | Smth | 200/532 |
| 4,740,661 | 4/1988 | Nishikawa et al. | 200/68.2 |
| 4,818,830 | 4/1989 | Bron | 200/341 |
| 5,004,880 | 4/1991 | Koutaka | 200/521 |
| 5,017,747 | 5/1991 | Nagahara et al. | 200/283 |
| 5,369,238 | 11/1994 | Hirata | 200/531 |

*Primary Examiner*—David J. Walczak

*Attorney, Agent, or Firm*—Renner, Otto, Boisselle & Sklar, P.L.L.

[57] ABSTRACT

The push switch of the invention includes: a case including a plurality of contact terminals placed on an inner bottom surface thereof and a contact member that includes a plurality of conductive protruding portions which come into contact with the plurality of contact terminals at selected positions while sliding on the inner bottom surface of the case; a fulcrum portion supported in a rotatable state by an axis parallel to the inner bottom surface of the case; and an elastic bent portion for connecting the protruding portions with the fulcrum portion. The push switch further includes a sliding body which is supported so as to move up and down along a direction vertical to the inner bottom surface of the case thereby pressing the contact member and sliding the conductive protruding portions in accordance with the vertical motion in order to switch the contact terminals between an electrical connection state and an electrical disconnection state. In the push switch, the contact member includes an opening through which at least a part of the sliding body passes and a portion for receiving a pressing force applied by the sliding body, and the sliding body includes a suppressing portion for pressing the contact member on a side thereof.

6 Claims, 3 Drawing Sheets

PUSH SWITCH

BACKGROUND OF THE INVENTION

1. Field of the Invention

The present invention relates to a push switch usable for various kinds of electronic devices.

2. Description of the Related Art

The construction of a conventional, prior art push switch will be described with reference to FIG. 4. Such a push switch includes: a case 16; a contact piece 9; a sliding body 10; and a cover 11.

The case 16 is formed substantially in a rectangular, parallelepiped shape and includes a fixed terminal 7 having a fixed contact 7*a* and a fixed terminal 8 having a fixed contact 8*a* on the inner bottom surface thereof.

The contact piece 9 is made of a conductive material having elasticity and includes: a fulcrum portion 9*b*; a bent portion 9*a*; and tongue pieces 9*e* and 9*f*. The fulcrum portion 9*b* is formed by outwardly bending an end portion of one side thereof so as to turn up. The bent portion 9*a* is bent substantially in a U shape. The tongue pieces 9*e*, 9*f*, are provided in the top end of the opposite side and have movable contacts 9*c* and 9*d*, respectively.

The sliding body 10 includes a bar portion and a suppressing portion 10*a*. The suppressing portion 10*a* is provided under the bar portion in order to suppress the upper part of the bent portion 9*a* of the contact piece 9. The sliding body 10 slides in the longitudinal direction.

The cover 11 engages the case 16, and includes an aperture 11*a* for enabling the sliding body 10 to slide therethrough and retaining the sliding body 10 and a concave portion 11*c*. The cover 11 and the case 16 support the contact piece 9 so that the fulcrum portion 9*b* of the contact piece 9 can rotate. More specifically, the contact piece 9 is interposed between the concave portion 11*c* provided in the lower bottom of the cover 11 and the inner bottom surface of the case 16.

Hereinafter, the operation of a conventional push switch having such a construction will be described with reference to FIGS. 5 and 6.

FIG. 5 is a side sectional view showing a conventional push switch in an OFF state. The movable contact 9*c* is always in contact with the fixed contact 7*a*. The upper part of the bent portion 9*a* is in contact with the suppressing portion 10*a* provided under the bar portion of the sliding body 10.

When a user depresses the sliding body 10, the conventional push witch is placed in an ON state as shown in FIG. 6. At this time, the bent portion 9*a* rotates around the fulcrum portion 9*b* at the center axis while bending the contact piece 9. The movable contact 9*c* is always in contact with the fixed contact 7*a*. As shown in FIG. 6, when the push switch is in the ON state, the movable contact 9*d* is in contact with the fixed contact 8*a*.

When the user removes the force depressing the sliding body 10, the recovery force of the contact piece 9 returns the conventional push switch to the OFF state as shown in FIG. 5. In this case, the contact piece 9 generates an angular moment in the clockwise direction.

However, when the push switch is in the OFF state, the height of the push switch increases by the thickness of the suppressing portion 10*a* of the sliding body 10 which is in contact with the upper part of the bent portion 9*a*. Therefore, it has been difficult to downsize such a conventional push switch.

SUMMARY OF THE INVENTION

The push switch of the invention includes a case including a plurality of contact terminals placed on an inner bottom surface thereof and a contact member that includes a plurality of conductive protruding portions which come into contact with the plurality of contact terminals at selected positions while sliding on the inner bottom surface of the case; a fulcrum portion supported in a rotatable state by an axis parallel to the inner bottom surface of the case; and an elastic bent portion for connecting the protruding portions with the fulcrum portion. The push switch further includes a sliding body which is supported so as to move up and down along a direction vertical to the inner bottom surface of the case, thereby pressing the contact member and sliding the conductive protruding portions in accordance with the vertical motion in order to switch the contact terminals between an electrical connection state and an electrical disconnection state. In the push switch, the contact member includes an opening through which at least a part of the sliding body passes and a portion for receiving a pressing force applied by the sliding body, and the sliding body includes a suppressing portion for pressing the contact member on a side thereof.

In one embodiment, the push switch further includes a cover with an aperture. The cover covers the case therewith, and the sliding body is retained within the aperture.

In another embodiment, when the push switch is in an ON state, at least two of the plurality of contact terminals are in contact with at least two of the plurality of conductive protruding portions.

In still another embodiment, when the push switch is in an OFF state, at least one of the plurality of contact terminals is in contact with at least one of the plurality of conductive protruding portions.

In still another embodiment, the contact member is interposed between the cover and the case.

In still another embodiment, the contact member is a conductive member having elasticity.

According to the present invention, the joint portion provided between the bent portion and the movable contact can be suppressed by the suppressing portion of the sliding body so that the height of the case can be reduced substantially by the thickness of the suppressing portion.

When the sliding body comes into direct contact with the case or the like, the sliding body is stopped. Therefore, it is possible to secure a sufficiently larger stopper strength for the sliding body. In addition, a moment causing an inclination, a twist or the like of the sliding body is not acted upon by the sliding body.

Thus, the invention described herein makes possible the advantage of providing a small sized push switch which can give an excellent feeling to an operator.

This and other advantages of the present invention will become apparent to those skilled in the art upon reading and understanding the following detailed description with reference to the accompanying figures.

DESCRIPTION OF THE PREFERRED EMBODIMENTS

Hereinafter, the construction of a push switch according to a preferred embodiment of the present invention will be described with reference to FIG. 1.

Figure 1:
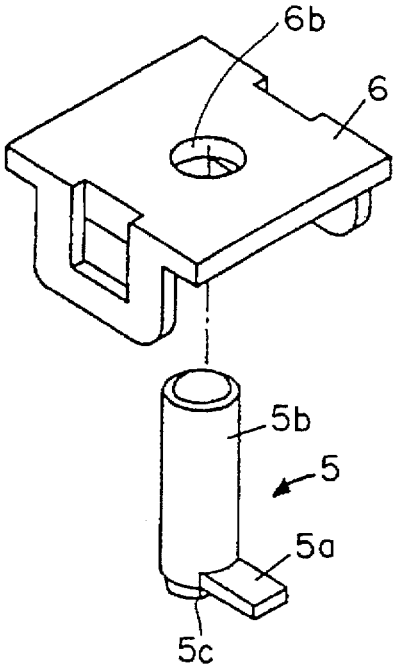
FIG. 1 is a partially exploded perspective view of a push switch in accordance with a preferred embodiment of the present invention.
Figure 1:
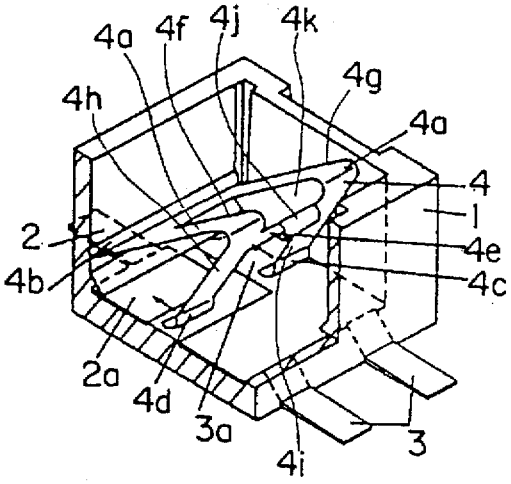

The push switch shown in FIG. 1 includes: a case 1; a contact member 4; a sliding body 5; and a cover 6.

The case 1 is formed in a substantially rectangular, parallelepiped shape. A contact terminal 2 having a fixed contact 2*a* and a contact terminal 3 having a fixed contact 3*a* are provided on the inner bottom surface 1*a* of the case 1. (See FIGS. 2 and 3) The fixed contacts 2*a* and 3*a* are provided on the inner side of the bottom of the case 1. The case 1 is not necessarily required to be formed in a rectangular, parallelepiped shape so long as the case 1 can be engaged with the cover 6.

The contact member 4 is made of a conductive material having elasticity. A specific configuration of the contact member 4 will now be described. Each of upper arm portions 4*f*, 4*g* is connected with a fulcrum portion 4*b* at one end thereof and at the other end thereof, with a joint portion 4*e* via bent portions 4*a* that are substantially U-shaped. As a result, the contact member 4 has an opening 4*k* surrounded by the upper arm portions 4*f*, 4*g*, the fulcrum portion 4*b* and the joint portion 4*e*. At least a part of the sliding body 5 can pass through the opening 4*k*.

The fulcrum portion 4*b* is formed by outwardly bending an end portion of the contact member 4 so as to turn up into contact with the cover 6. The fulcrum portion 4*b* may be formed in any arbitrary shape so long as the fulcrum portion 4*b* can support a part of the contact member 4 so that the upper arm portions 4*f*, 4*g* can rotate around an axis parallel to the inner bottom surface 1*a* of the case 1.

Lower arm portions 4*h*, 4*i* are connected with the joint portion 4*e*. Movable contacts 4*c*, 4*d* are provided at the respective ends of the lower arm portions 4*i*, 4*h*. It is noted that the movable contacts 4*c*, 4*d* can be protruding portions.

A curl portion 4*j* is bent in a circular shape so as to be in contact with a suppressing portion 5*a* to be described below and is provided substantially in the center of the joint portion 4*e*.

The sliding body 5 includes: a cylindrical body portion 5*b*; a suppressing portion 5*a* provided in the lower part of the body portion 5*b*; and a bottom portion 5*c*. The suppressing portion 5*a* may be always in contact with the joint portion 4*e*. When the body portion 5*b* is depressed in the longitudinal direction (or the vertical direction), the suppressing portion 5*a* and a part of the body portion 5*b* pass through the opening 4*k* with the suppressing portion 5*a* in contact with the joint portion 4*e*. The body portion 5*b* may be formed in any arbitrary shape so long as the body portion 5*b* can be inserted into an aperture 6*b* of the cover 6 and the body portion 5*b* can slide in the longitudinal direction. The sliding body 5 can be formed by molding a resin.

The cover 6 includes a supporting portion 6*a* and the aperture 6*b*. The sliding body 5 can slide and be retained through the aperture 6*b*. Note that, in the case where the push switch of the invention does not include the cover 6, the sliding body 5 can be retained by the case 1.

The contact member 4 is supported so as to be interposed between the supporting portion 6*a* and the case 1. The supporting portion 6*a* is in contact with the fulcrum portion 4*b* and the movable contact 4*d* is in contact with the case 1 or the fixed contact 2*a*. The movable contact 4*c* is in contact with the fixed contact 3*a*. The upper arm portions 4*f*, 4*g* of the contact member 4 rotate around the contact region between the fulcrum portion 4*b* and the supporting portion 6*a* as a center axis. It is noted that the fulcrum portion can be provided for the case 1 so long as the fulcrum portion can support the contact member 4 in a rotatable state by an axis parallel to the bottom portion of the case 1.

In addition, three or more fixed contacts can also be provided on the inner bottom surface 1*a* of the case 1. In such a case, the electrical connection states can be switched between the contact terminals having the fixed contacts depending upon the position of the contact member 4. Furthermore, three or more movable contacts can also be provided for the contact member 4. In such a case, the electrical connection states can also be switched between the contact terminals having the fixed contacts depending upon the position of the contact member 4. Even when three or more fixed contacts are provided on the inner bottom surface 1*a* of the case 1 and three or more movable contacts are provided for the contact member 4, the same effects can be attained.

Figure 2:
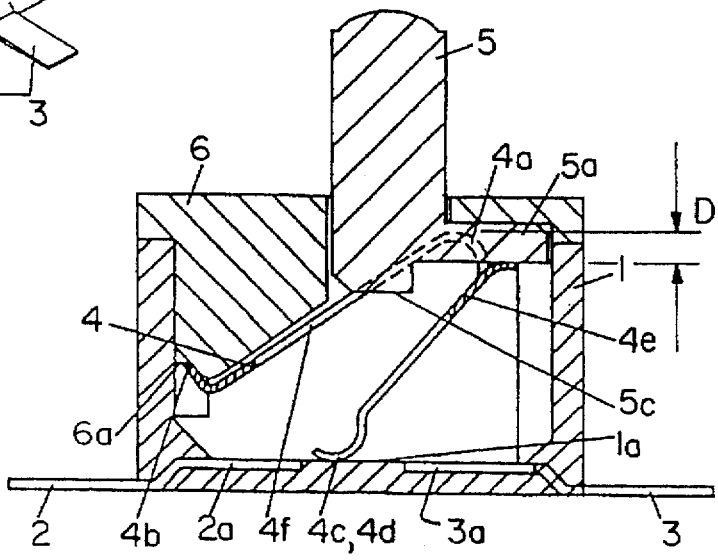
FIG. 2 is a side sectional view of the push switch shown in FIG. 1.
Figure 3:
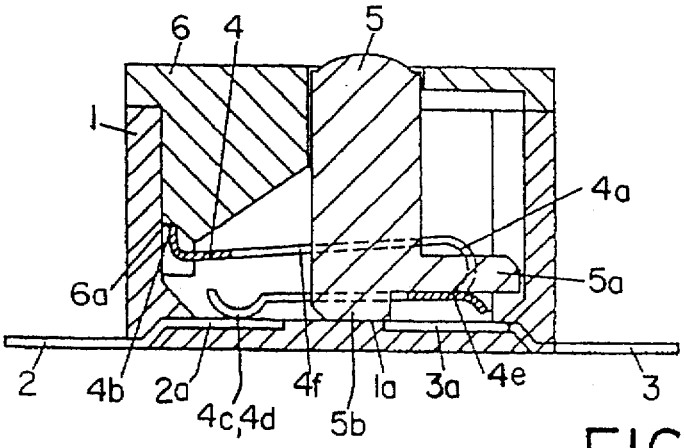
FIG. 3 is a side sectional view of the push switch shown in FIG. 1 illustrating a state where the sliding body is depressed.
Figure 4:
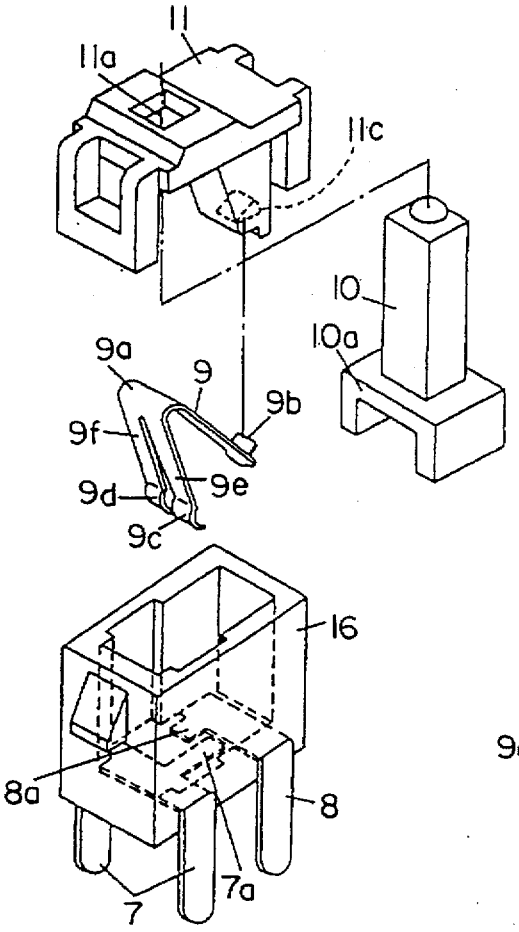
FIG. 4 PRIOR ART
FIG. 4 is an exploded perspective view of a conventional prior art push switch.
Figure 5:
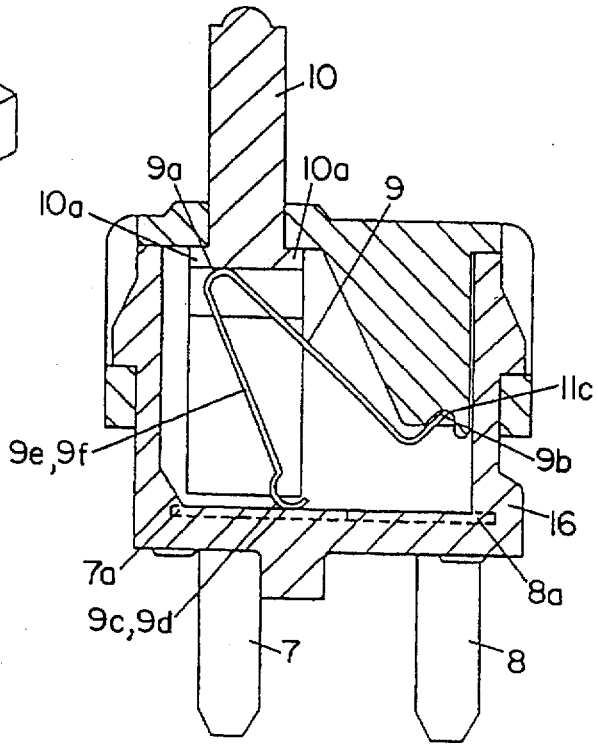
FIG. 5 PRIOR ART
FIG. 5 is a side sectional view of the push switch shown in FIG. 4.
Figure 6:
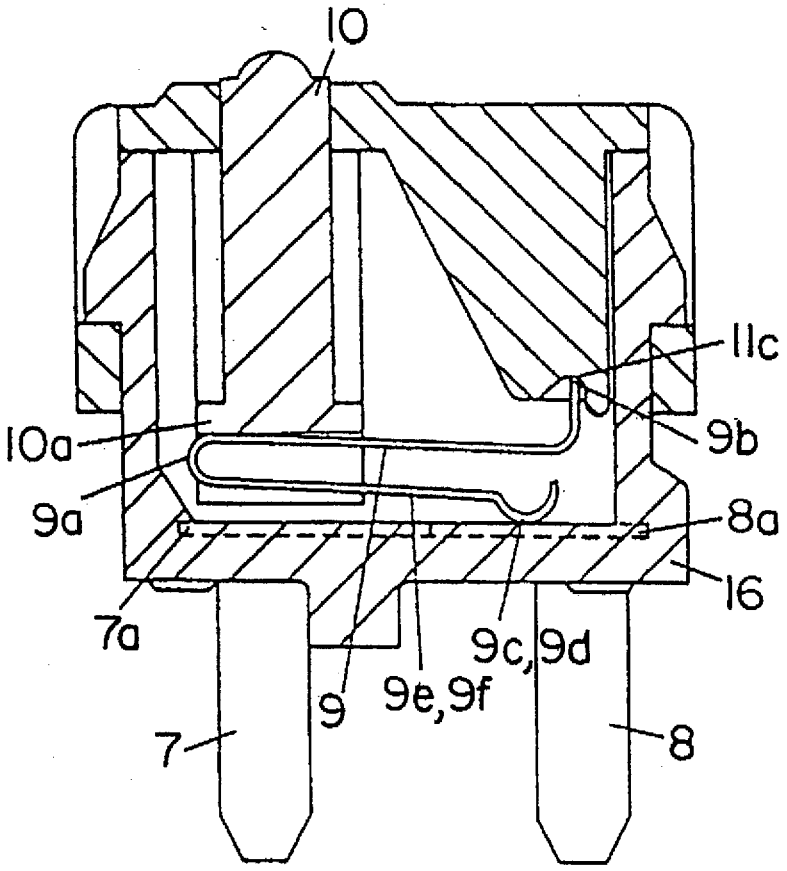
FIG. 6 PRIOR ART
FIG. 6 is a side sectional view of the push switch shown in FIG. 4 illustrating a state where the sliding body is depressed.

Hereinafter, the operation of the push switch shown in FIG. 1 will be described with reference to FIGS. 2 and 3. FIG. 2 is a side sectional view showing that the push switch shown in FIG. 1 is in an OFF state. When the push switch is in the OFF state, there is no electrical connection between the contact terminals 2 and 3 of the push switch. FIG. 3 is a side sectional view showing that the push switch shown in FIG. 1 is in an ON state. When the push switch is in the ON state, there is an electrical connection between the contact terminals 2 and 3 of the push switch.

The ON/OFF states are switchable depending upon the shapes of the fixed contacts 2*a* and 3*a*. Depending upon the shapes of the fixed contacts 2*a* and 3*a*, the ON/OFF states shown in FIGS. 2 and 3 are sometimes inverted. In such a case, the state shown in FIG. 2 is called an ON state and the state shown in FIG. 3 is called on OFF state.

In the state shown in FIG. 2, the movable contact 4*c* is in contact with the fixed contact 3*a*.

When a user starts depressing the sliding body 5, the suppressing portion 5*a* provided in the lower part of the sliding body 5 comes into contact with the joint portion 4*e* of the contact member 4 during the rotation of the upper arm portions 4*f*, 4*g* around the fulcrum portion 4*b* as a center axis. When the depressing force of the sliding body 5 is applied to the contact member 4, the bent portions 4*a* are bent in particular.

FIG. 3 shows that the push switch is in the ON state. As shown in FIGS. 2 and 3, the movable contact 4*c* is always in contact with the fixed contact 3*a*. Before the sliding body 5 is depressed, the movable contact 4*d* is in contact with the inner bottom surface 1*a* of the case 1. When the sliding body 5 is depressed, the movable contact 4*d* comes into contact with the fixed contact 2*a*. At this time, the bottom portion 5*c* of the sliding body 5 passes through the opening between the lower arm portions 4*h*, 4*i* of the contact member 4 so as to come into direct contact with the inner bottom surface 1*a* of the case 1 and/or the fixed contacts 2*a*, 3*a*.

When a user removes the depressing force, the recovery force of the contact member 4 recovers the state of the push switch shown in FIG. 2. At this time, an angular moment is generated in the contact member 4 in the counterclockwise direction. The fixed contact 2*a* may be located so that the movable contact 4*d* is in contact with the fixed contact 2*a* and the inner bottom surface 1*a* of the case 1 before the depression of the sliding body 5 and also such that the movable contact 4*d* is in contact with the inner bottom surface 1*a* of the case 1 when the sliding body 5 is depressed.

In the push switch of the present invention, the contact member 4 is in contact with the suppressing portion 5*a* of the sliding body 5 not at the bent portion 4*a* of the contact member 4, but at the joint portion 4*e* of the contact member 4 so that the height of the push switch can be reduced by the thickness D. As a result, it is possible to sufficiently secure the elasticity of the contact member 4 without shortening the length of the upper arm portions and the like.

During depression of the sliding body 5 the bottom portion 5*c* of the sliding body 5 comes into contact with the inner bottom surface 1*a* of the case and/or the fixed contacts 2*a*, 3*a*, so that the sliding body 5 is stopped. Therefore, as compared with a push switch in which the sliding body 5 is not in contact with the inner bottom surface 1*a* of the case when the sliding body reaches a lowermost position, it is possible to secure a sufficiently large stopper strength for the sliding body 5. In addition, a moment causing an inclination, a twist or the like of the sliding body 5 is not acted upon the sliding body 5.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed:

1. A push switch comprising:

a case including a plurality of contact terminals placed on an inner bottom surface thereof;

a contact member including: a plurality of conductive protruding portions which come into contact with the plurality of contact terminals at selected positions while sliding along the inner bottom surface of the case; a fulcrum portion supported in a rotatable state by an axis parallel to the inner bottom surface of the case; and an elastic bent portion for connecting the protruding portions with the fulcrum portion; and a sliding body which is supported so as to move up and down along a direction vertical to the inner bottom surface of the case thereby pressing the contact member and sliding the conductive protruding portions in accordance with the vertical motion in order to switch the contact terminals between an electrical connection state and an electrical disconnection state;

wherein the contact member includes an opening through which at least a part of the sliding body passes and a portion for receiving a pressing force applied by the sliding body;

wherein the sliding body includes a suppressing portion for pressing the contact member on a side thereof at the portion for receiving a pressing force, wherein in at least an unpressed state, a highest portion of the contact member is interposed between the portion for receiving the pressing force and a surface of the case through which the sliding body extends.

2. A push switch according to claim 1, further comprising a cover for covering the case therewith, the cover including an aperture within which the sliding body is retained.

3. A push switch according to claim 1 wherein when the push switch is in an ON state, at least two of the plurality of contact terminals are in contact with at least two of the plurality of conductive protruding portions.

4. A push switch according to claim 1 wherein when the push switch is in an OFF state, at least one of the plurality of contact terminals is in contact with at least one of the plurality of conductive protruding portions.

5. A push switch according to claim 1 wherein the contact member is interposed between the cover and the case.

6. A push switch according to claim 1 wherein the contact member is a conductive member having elasticity.

* * * * *